United States Patent [19]

Holmstrand

[11] Patent Number: 4,850,157

[45] Date of Patent: Jul. 25, 1989

[54] APPARATUS FOR GUIDING THE FLOW OF ABRASIVE SLURRY OVER A LAPPING SURFACE

[75] Inventor: Allan L. Holmstrand, Bloomington, Minn.

[73] Assignee: Magnetic Peripherals Inc., Minneapolis, Minn.

[21] Appl. No.: 123,967

[22] Filed: Nov. 23, 1987

[51] Int. Cl.[4] ..... B24B 7/00

[52] U.S. Cl. ..... 51/128; 51/263; 51/292

[58] Field of Search ..... 51/125, 124 R, 125.5, 51/263, 229, 292, 326

[56] References Cited

U.S. PATENT DOCUMENTS

| | | | |
|---|---|---|---|
| 1,618,085 | 2/1927 | Hess | 51/292 |
| 2,180,952 | 11/1939 | Gattoni | 51/124 |
| 2,299,678 | 10/1942 | Boynton | 51/263 |
| 3,270,465 | 9/1966 | Decoulos | 51/263 |
| 4,256,535 | 3/1981 | Banks | 51/281 R |
| 4,270,316 | 6/1981 | Krämer et al. | 51/283 R |
| 4,347,689 | 9/1982 | Hammond | 51/281 SF |
| 4,459,781 | 7/1984 | Li | 51/123 R |
| 4,536,992 | 8/1985 | Hennenfent et al. | 51/124 |
| 4,590,422 | 5/1986 | Milligan | 51/5 R |

*Primary Examiner*—Frederick R. Schmidt
*Assistant Examiner*—Robert A. Rose
*Attorney, Agent, or Firm*—Edward P. Heller, III; Frederick W. Niebuhr; Edward L. Schwarz

[57] ABSTRACT

A wiper guide assembly, mounted at the free end of a workpiece carrying arm, can be selectively released to position a neoprene wiper blade against a lapping surface, and retracted whereby the blade is lifted away from the lapping surface. The wiper blade is located just ahead of a workpiece supported by the arm, and between the workpiece and a source of abrasive slurry supplied to the lapping surface. When retracted, the wiper blade is spaced apart from the lapping surface to expose its associated workpiece to the abrasive slurry, permitting more rapid removal of material. When the assembly is released, the wiper blade contacts the lapping surface in a wiping engagement, to guide or divert slurry away from the workpiece, whereby the lapping surface contiguous with and about the workpiece is comparatively free of abrasive slurry.

20 Claims, 2 Drawing Sheets

APPARATUS FOR GUIDING THE FLOW OF ABRASIVE SLURRY OVER A LAPPING SURFACE

BACKGROUND OF THE INVENTION

This invention relates to the abrading of workpiece surfaces, and more particularly to high precision lapping of magnetic transducing heads, utilizing a lapping surface and an abrasive liquid or slurry.

Throughout the broad range of data storage products, one constant seems to be the ever present challenge to increase the density of stored data. This allows storage of more data on a given surface area, and leads to product miniaturization, resulting in strict tolerances for linear dimensions and planarity measured in micro inches (millionths of an inch). Such tolerances call for machining processes and devices capable of meeting them. U.S. Pat. No. 4,270,316 (Kramer) discloses a process for polishing semiconductor discs, in which elastic bodies are positioned between the pressure piston and the back of the carrier plate in order to reduce the variance in pressure transmission between these members, resulting in a more uniform thickness throughout the disc. In U.S. Pat. No. 4,256,535 (Banks), a thin layer of water is interposed between a substrate and a semiconductor wafer mounted on the substrate, prior to positioning the substrate and wafer on a rotating polishing pad.

An apparatus for burnishing the magnetic oxide coating on flexible discs is disclosed in U.S. Pat. No. 4,347,689 (Hammond). A head supports a burnishing tape for movement relative to the surface being polished. A deformable cotton swab is contained in a cylindrical slot in the head, with an exposed portion of the swab elastically deformed and contacting the tape. Further, U.S. Pat. No. 4,459,781 (Li) discloses a grinding or polishing apparatus in which mixed abrasive particles, through either screen printing or a centrifugal process, are formed in concentric rings of decreasing particle size toward the center of an abrading wheel. Then, more refined polishing is accomplished simply by moving a workpiece radially inward relative to the wheel.

Magnetic transducing heads, used for example with rotatable magnetic discs in disc drives, are subject to especially fine manufacturing tolerances. Typical abrading equipment includes a lapping surface in which abrasive particles (e.g. diamond fragments) are embedded, and an abrasive slurry, e.g. a water soluble glycol base containing abrasive particles such as diamond fragments. As explained in U.S. Pat. No. 4,536,992 (Hennenfent et al), incorporated by reference as a part of this application, it is essential in thin film heads to control the throat height of the magnetic flux gap. Thin film transducers typically are formed by applying layers of an electrically conductive material (e.g. copper) and a magnetic flux conducting core or pole piece material encapsulated in aluminum oxide, along one side of a comparatively large body or slider, typically a ceramic material including aluminum oxide and titanium carbide. In use, the planar bottom surface of the slider is spaced vertically apart from a horizontal magnetic recording surface of the disc, supported by a film of air. The metallic layer, aluminum oxide and pole piece lie along a vertical edge of the slider, typically the trailing edge.

For increasing data density, the principal concerns include controlling and minimizing the vertical distance between the pole pieces (specifically the pole tips) and the magnetic recording surface. To this end, the slider bottom surface and pole tips should be, to the extent possible, co-planar. However, because the pole piece and immediately adjacent layers are more amenable to abrasive removal than the ceramic slider, normal lapping tends to more readily remove these layers, creating a problem known as pole tip recession. As a consequence of pole tip recession, the core material is separated from the recording surface at a distance greater than the slider bottom surface.

A related imperfection or deviation from co-planarity, is the unintentional rounding of the edge of the transducing head comprised of the core and adjacent layers. This rounding sometimes referred to as dubbing, occurs when the lapping surface is moved in a direction to encounter the transducing layers first. The curvature may or may not affect the height of the pole pieces, but it can undesirably influence the aerodynamics of the transducing head.

While pole tip recession and curvature can be reduced by slowing down the abrading rate, this has the unwanted side effect of substantially increasing machining time.

Therefore, it is an object of the present invention to provide a lapping process which achieves improved co-planarity without any substantial reduction in total abrasion time.

Another object of the invention is to provide an apparatus, using an abrasive slurry in conjunction with an abrasive lapping surface, for diverting the slurry away from a workpiece at selected times during abrasion.

Yet another object is to provide a retractable wiping apparatus, particularly suited for use with the precision lapping system disclosed in U.S. Pat. No. 4,536,992, positionable into a wiping engagement with the lapping plate at a selected time and just ahead of a workpiece, to guide abrasive slurry around and past the workpiece.

SUMMARY OF THE INVENTION

To achieve these and other objects, there is provided an apparatus for machining a workpiece. The apparatus includes a substantially rigid frame, and a lapping member mounted movably with respect to the frame and having a substantially flat and horizontal lapping surface. A workpiece carrier is mounted with respect to the frame for positioning a workpiece against the lapping surface and in a selected orientation. An abrasive supply means provides an abrasive slurry to the lapping surface at a select location with respect to the frame. Means is provided for moving the lapping member in a generally longitudinal first direction with respect to the frame, thereby to carry the abrasive slurry, when so provided, toward the workpiece. The apparatus includes a guide member, and a reciprocable support means for selectively and alternatively supporting the guide member in an operating position and in a retracted position. The guide member, when in the operating position, is in wiping engagement with the lapping surface over a wiping portion of the lapping surface spanning a transverse distance at least as great as the transverse dimension of the workpiece, to substantially divert the abrasive slurry, when so carried by the lapping member, transversely away from the workpiece. When retracted, the guide member is spaced apart from the lapping surface to allow the lapping member to carry the abrasive slurry to the workpiece.

Preferably, the guide is a neoprene wiper blade supported by an elongate, substantially rigid and transverse guide bar. The bar can be supported by a yoke, and pivot relative to the yoke about a longitudinal axis. The yoke, in turn, can be pivotally supported about a transverse axis with respect to the workpiece carrier. A latching arm can be mounted pivotally to the workpiece carrier, for selectively retracting and releasing the guide bar. When released, the wiper blade rests on the lapping surface, maintained against the surface by gravity.

When employed with a rotating lapping plate, the wiper blade preferably is radially aligned with the plate, so that it tends to divert the abrasive slurry substantially equally to both sides. Consequently, when in contact with the lapping surface, the wiper blade forms a substantially dry plate region behind it and surrounding the workpiece. In a multiple workpiece configuration such as that shown in FIG. 5 of the aforementioned U.S. Pat. No. 4,536,992, the guide for one of the workpieces can be in wiping engagement, while slurry is provided to the remaining workpieces.

In the dry plate region, the amount of free abrasive is substantially reduced, which tends to slow the lapping rate. In connection with the lapping of transducing heads, however, the dry plate lapping substantially improves co-planarity. For example, the dry plate approach has been found to substantially reduce pole tip recession, from an average of 2.4 microinches to 1.5 microinches. The distribution about (or deviation from) the average also is reduced, for greater consistency.

In accordance with the present invention, the wiping guide is employed selectively, during perhaps the last five percent or so of material removal. Consequently, in exchange for a slight increase in total lapping time, there is achieved a substantial reduction in pole tip recession, and dubbing or curvature of the trailing edge is virtually eliminated.

IN THE DRAWINGS

For a better understanding of the above and other features and advantages, reference is made to the following detailed drawings, in which.

Figure 6:
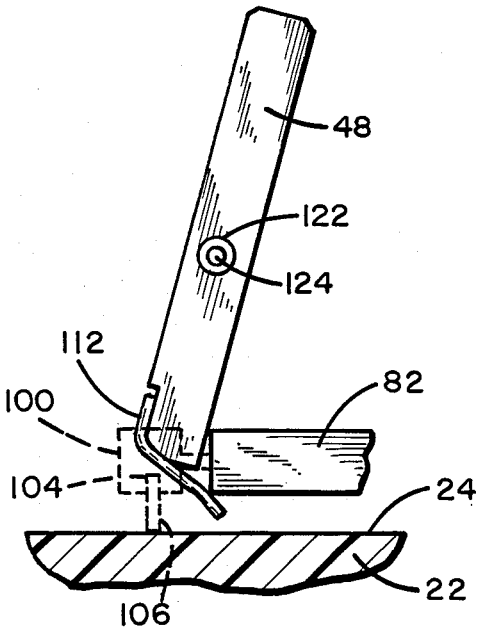
Figure 5:
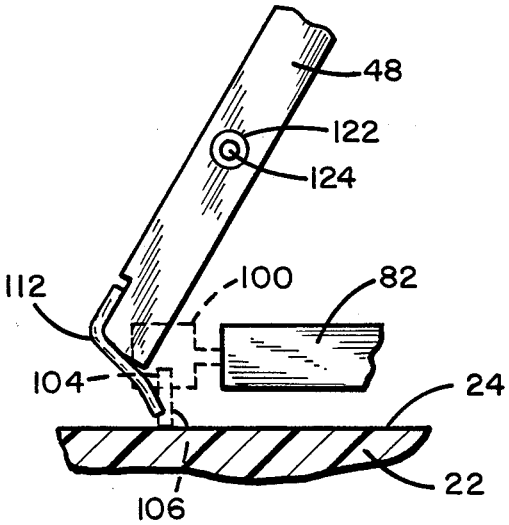
Figure 7:
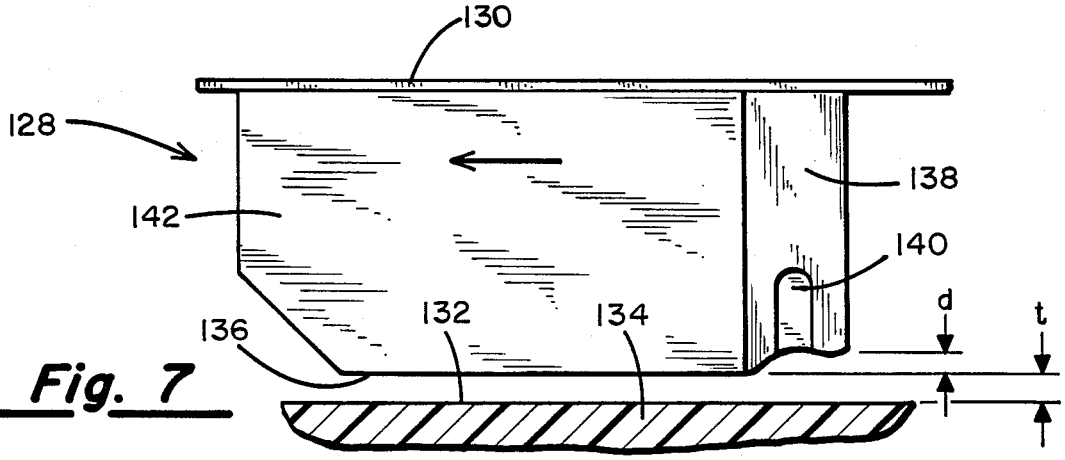

FIGS. 5 and 6 schematically illustrate the operation of a latch provided for selectively releasing and retracting the wiper guide assembly; and FIG. 7 is an enlarged view of a magnetic transducing head and a magnetic disc.

DETAILED DESCRIPTION OF THE PREFERRED EMBODIMENT

Figure 1:
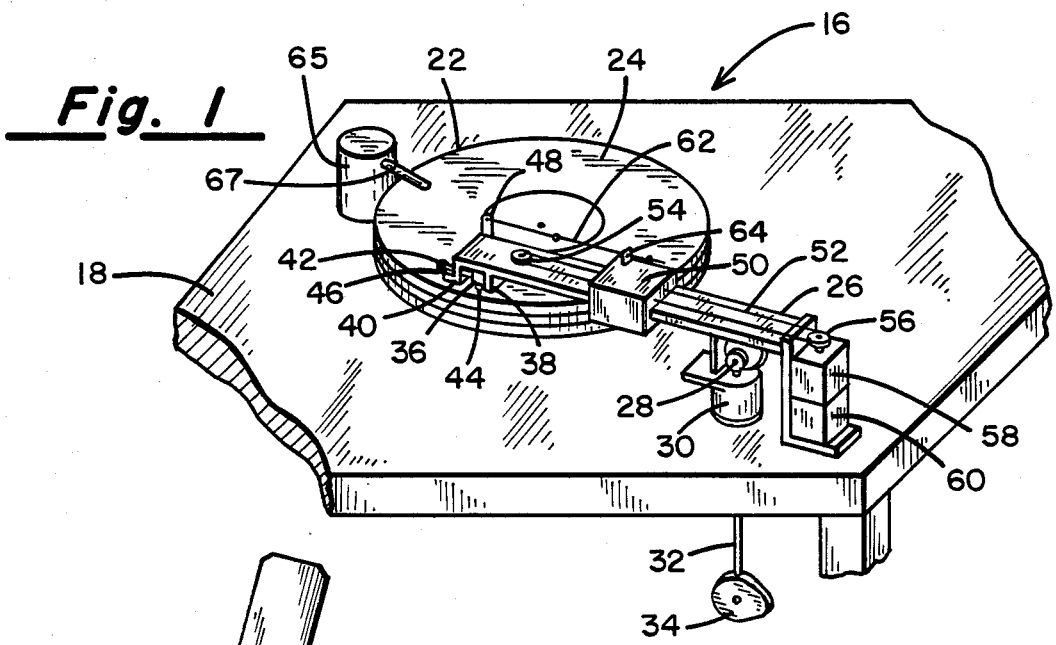
FIG. 1 is a perspective view of a device for lapping magnetic transducing heads in accordance with the present invention.

Turning now to the drawings, there is shown in FIG. 1 a lapping device 16 for precisely machining workpieces. The device includes a frame 18 supported by four legs, one of which is shown in part at 20. A lapping plate 22 is mounted with respect to frame 18 for rotation about a vertical axis, and has an annular, horizontal lapping surface 24.

A carrier arm assembly including an elongate carrier arm 26 is mounted with respect to the frame through a universal arm pivot 28, an arm supporting collar 30 and vertical shaft 32. A cam 34 beneath the frame is rotatable in order to raise and lower shaft 32, to selectively determine the inclination of carrier arm 26 with respect to the frame as it supports a workpiece on lapping surface 24.

A workpiece holder 36 is supported between first and second downwardly depending arm portions 38 and 40 at the forward end of the arm, by virtue of screws 42 extending longitudinally through first portion 40 and maintaining holder 36 frictionally against portion 38. The workpiece holder in turn supports the workpiece, in this case a slider bar 44. A wiper guide assembly 46 is supported with respect to the carrier arm near arm portion 38, to reciprocate with respect to the carrier arm between an operating position on lapping surface 24, and a retracted position supported by a latch arm 48 mounted pivotally to the forward end of the carrier arm.

A weight 50 is mounted to slide longitudinally with respect to arm 26. An endless belt 52 drivably associates an idler pulley 54 and driven pulley 56 with weight 50 whereby a motor 58, illustrated schematically at the rearward end of the carrier arm, is operable to controllably position the weight along the arm, thereby to control the amount of downward force applied to the workpiece. Beneath motor 58 is a second weight 60, transversely movable with respect to the arm, in order to further control the distribution of force applied to the workpiece.

An actuator link 62 is mounted pivotally with respect to latch arm 48 and slides with respect to a link supporting bracket 64 integral with weight 50. This enables control of guide assembly 46 through movement of the weight, as is later explained. A container 65 holds an abrasive slurry and supplies the slurry to lapping surface 24 through a nozzle 67. While following figures are directed to the wiper guide assembly, the reader interested in more detail concerning other features of lapping device 16 is referred to the aforementioned U.S. Pat. No. 4,536,992.

FIGS. 2–5 show wiper guide assembly 46 in greater detail. First and second wiper guide support brackets 66 and 68 are mounted integrally to carrier arm 26 on parallel and opposed extensions 70 and 72 of the arm. Each of brackets 66 and 68 has a horizontal upper leg 74 attached directly to the arm, a downwardly depending upright medial portion 76, and a horizontal lower leg 78 extended forwardly of medial portion 76. An opening 80 is provided near the forward end of each lower leg.

A substantially rigid yoke 82 is supported relative to brackets 66 and 68 through pivot pins 84 and 86, for pivoting about a transverse axis. Yoke 82 includes a transversely extended central body portion 88, with first and second parallel and opposed longitudinal extensions 90 and 92 at opposite ends of central portion 88. Pins 84 and 86 are fixed near the forward ends of extensions 90 and 92, respectively. Formed through the center of portion 88 is a longitudinal opening 94. A shoulder screw 96 through longitudinal opening 94 is maintained by a retaining ring 98 on the opposite side of yoke 82 from the enlarged head of the screw.

A guide bar 100 has a centrally disposed opening for receiving the rearwardly extended portion of shoulder screw 96, whereby the guide bar is mounted pivotally relative to yoke 8 about a longitudinal axis. A slot 104 runs generally the length of guide bar 100 and is open to the downwardly facing surface of the guide bar. Supported in the slot is an elongate wiper blade 106, preferably constructed of neoprene, although other materials can be employed, for example various silicone rubbers or urethanes. The primary considerations are flexibility and chemical compatibility with the abrasive slurry. Wiper blade 106 is elongate and rectangular in cross-section, with a vertically disposed cross-sectional width substantially greater than its horizontally disposed cross-sectional thickness. The wiper blade projects downwardly beyond the guide bar. Due to the pivotal mounting of guide bar 100 relative to yoke 82, wiper blade 106 can accurately track lapping surface 24 without requiring that pivot pins 84 and 86 support the yoke in a precise alignment with the lapping surface.

Figure 3:
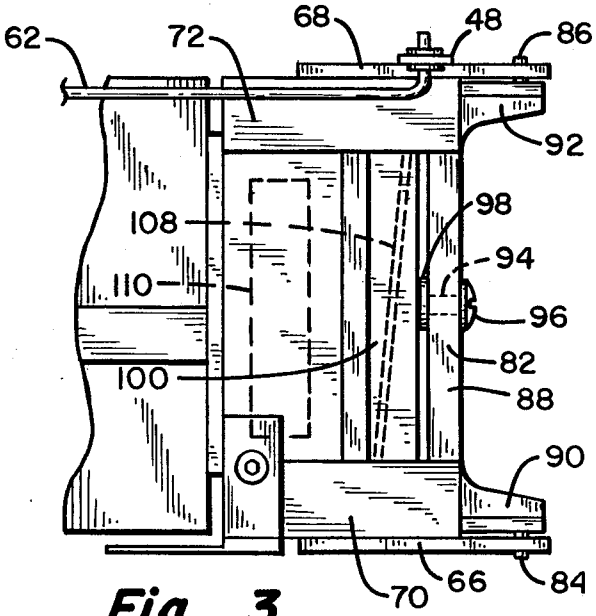
FIG. 3 is a top view of a portion of the arm and further illustrating the wiper guide assembly.

In the operating position, wiper blade 106 contacts the lapping surface over a wiping surface area 108 slightly inclined from the transverse direction (FIG. 3). In contrast, a working surface area 110, shown in broken lines and representing workpiece/lapping surface contact is transverse. This is due to the annular configuration of lapping surface 24. In particular, working surface area 110 is generally aligned with a radius of lapping plate 22. Wiper blade 106 likewise is aligned with a radius of the lapping plate, so that it tends to guide or divert abrasive slurry substantially equally in opposite radial directions. Thus the diverted slurry surrounds working surface area 110 on both sides, to avoid an undesirable "snowplow" effect of diverting all or most of the abrasive slurry to one side.

Also apparent from FIG. 3 is that wiping surface area 108 has a transverse span greater than the transverse length of working surface area 110. This arrangement is preferred, due to the tendency of the liquid abrasive slurry, although viscous, to flow transversely over lapping surface 24 and merge the two slurry streams created by wiper blade 106 when in contact with the lapping surface. In short, this guarantees that working surface area 110 remains substantially free of abrasive slurry.

Figure 2:
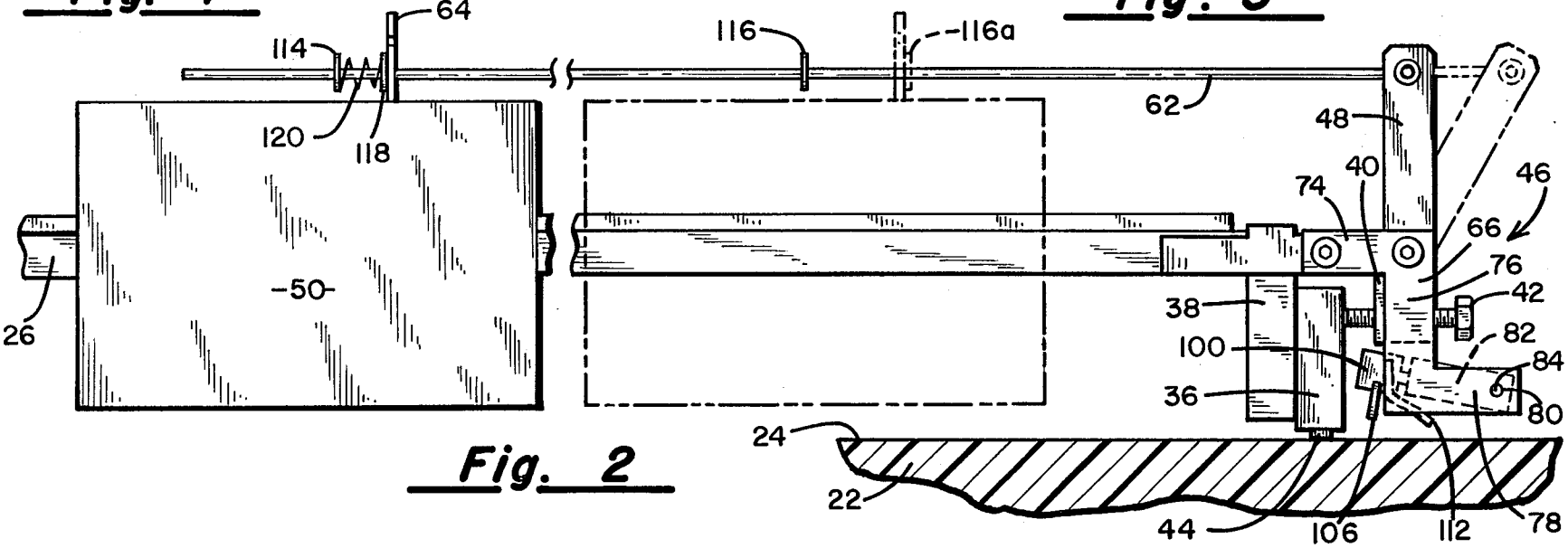
FIG. 2 is an enlarged side elevation of a workpiece carrying arm of the device shown in FIG. 1, and a wiper guide assembly supported with respect to the arm.
Figure 4:
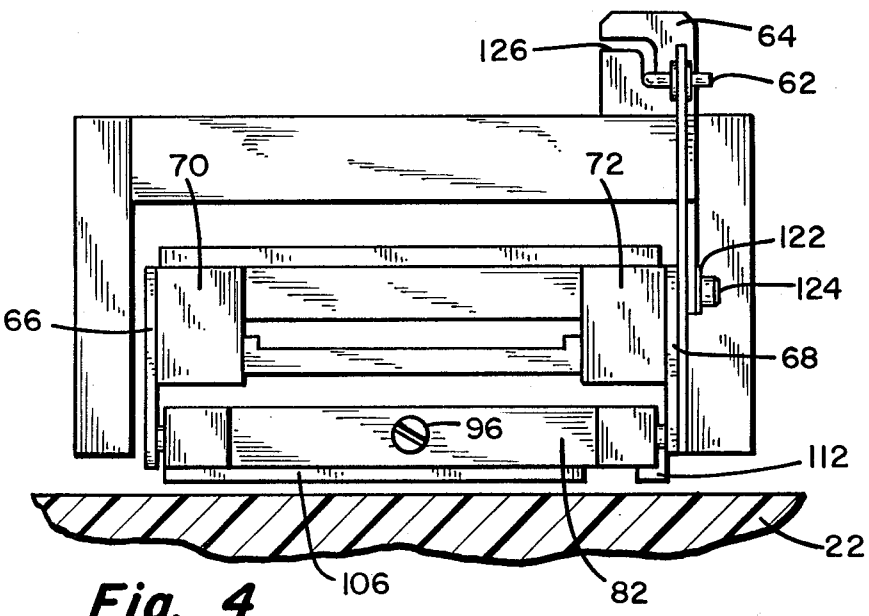
FIG. 4 is a front elevation of the arm and wiper guide assembly.

In FIG. 2, latch arm 48 is shown in solid lines in its upright or latching position, in which a latch 112, depended from the bottom of the latching arm, is engaged with yoke 82 and supports it in an upwardly and rearwardly inclined position as shown, thus to support wiper blade 106 spaced apart from the lapping surface. When rotated clockwise as viewed in the figure, latch arm 48 carries latch 112 away from yoke 82, permitting the yoke to rotate counterclockwise until wiper blade 106 contacts the lapping surface. Weight 50, selectively driven by motor 58 through belt 52, functions as an actuator member for selectively moving the latch arm between its upright and release positions.

First and second retaining rings 114 and 116, mounted to actuator link 62 on opposite sides of bracket 64, limit the sliding of the bracket relative to the actuator link. More particularly, when weight 50 is moved to its rearwardmost position as shown in solid lines in FIG. 2, bracket 64 encounters a washer 118 and compresses a coil spring 120 between the washer and first retaining ring 114, thus translating link 62 to the left as viewed in the figure and rotating latch arm 48 counterclockwise to its upright position. Spring 120 and washer 118 enlarge an otherwise strict tolerance for the positioning of retaining ring 114. When latch arm 48 is upright, bracket 64 encounters second retaining ring 116 before weight 50 has reached its forwardmost position. Continued forward movement of the weight and bracket carry retaining ring 116 to a forward location shown in broken lines at **116*a*. This translates actuator link 62 forwardly, thus to pivot the latching arm clockwise and release yoke 82**.

The forwardmost and rearwardmost locations for weight 50 preferably are beyond its normal operating range when used to control the downward force on slider bar 44 (see the aforementioned U.S. Pat. No. 4,536,992). To avoid any tendency in latch arm 48 to pivot unless actuated, a spring washer 122 (FIG. 4) is positioned between a shoulder screw 124 pivotally mounting the latching arm to wiper guide support bracket 68. A right angle slot 126, formed in link support bracket 64, slidably supports the actuator link.

FIGS. 5 and 6 schematically illustrate latch arm 48 in the release position and in an intermediate position, respectively. With yoke 82 free of latch 112 as shown in FIG. 5, wiper blade 106 contacts lapping surface 24, supports guide bar 100 and, through shoulder screw 96, also supports the yoke.

As latch arm 48 pivots counterclockwise, it carries latch 112 into contact with yoke 82, particularly at its bottom left corner as viewed in FIGS. 5 and 6. Further counterclockwise pivoting of the latch arm carries the latch beneath the yoke, thus lifting yoke 82 to pivot it clockwise, eventually to the inclined position shown in FIG. 2. When the yoke and guide bar are retracted, guide bar pivoting about the longitudinal axis of shoulder screw 96 is prevented by forward arm extensions 70 and 72. Spring washer 122 and shoulder screw 124 maintain the latch arm upright until it is pivoted clockwise through forward movement of link 62. Such pivoting carries latch 112 away from yoke 82, whereupon guide bar 100 and wiper blade 106 descend to the lapping surface once again.

As mentioned above, lapping device 16 is particularly well suited for precisely abrading a workpiece comprising one or more magnetic transducing heads, such as a head 128 shown in FIG. 7. In use, head 128 is supported by a gimbal spring 130 or other means to allow degrees of freedom in adjusting to slight irregularities in a recording surface 132 of a magnetic disc 134. Disc 134 is rotated to impart to head 128 a "movement" relative to the disc in the direction of the arrow (leftward in the figure), and at a sufficient speed so that head 128 is supported with its bottom surface 136 spaced apart from recording surface 132, on a cushion of air having a thickness t. As previously noted, an aluminum oxide layer 138 and a core or pole piece 140, deposited along the trailing edge of a slider 142, are more readily removed by abrasive material, thus to cause an undercutting or pole tip recession, shown in FIG. 7 as distance d. Consequently, the pole tips are spaced from recording surface 132 a distance $t+d$. Since increasing data density depends in part on minimizing the pole tip/recording surface separation, it is an advantage to reduce d as much as possible.

In accordance with the present invention, distance d is substantially reduced through a properly timed release of the wiper guide assembly. As an example, bottom surface 136 of head 128 is machined while part of a workpiece including a plurality of heads separated after the lapping process, in a manner noted in the aforementioned U.S. Pat. No. 4,536,992. Such lapping can involve removal of approximately six hundred microinches of material. Approximately ninety-five percent of the material, or about the first five hundred seventy microinches, are lapped in the manner described in the '992 Patent. A difference, however, is that a point at which about thirty microinches of material remain is sensed, rather than the point at which lapping is complete. In response to the sensing of approximately thirty microinches remaining, motor 58 is actuated to move weight 50 to its forwardmost position, thus to pivot latch arm 48 clockwise (FIG. 2) and release yoke 82. Wiper blade 106 falls into place just ahead of slider bar 44, thus to guide or divert most of the abrasive slurry transversely, around and beyond working surface area 110. Consequently, over the course of lapping the final thirty microinches or so, lapping surface 24 at working surface area 110 is comparatively dry, or free of the abrasive slurry and its free-floating abrasive particles.

Under the dry lapping surface approach, the pole tip recession has been found to be much less severe. In fact, distance d, in terms of its average value, has been reduced from about 2.4 microinches to 1.5 microinches. Improved consistency is achieved, in terms of reduced deviation from the average value of d. Yet another advantage is the virtual elimination of trailing edge dubbing. Of course, the essentially dry lapping surface removes material at a reduced rate. However, since the wiper guide assembly is released during only the final five percent of material removal, the reduced lapping rate has a minimal affect on total lapping time.

Thus, the present invention allows a controlled combination of the higher machining rates available with abrasive slurry and the more accurate dry lapping over the final, critical microinches of material removal, to form a precision surface. While particularly well suited for lapping the flying surfaces of transducing heads, the present invention can be employed in any abrading process involving an abrasive slurry, where it is desired, over a predetermined segment of the process, to channel the abrasive slurry away from a particular workpiece. The wiper guide assemblies are particularly well suited for operations in which multiple workpieces contact a single abrading surface. Then, one or more selected workpieces can be abraded with an essentially dry surface, with the remaining workpieces exposed to the abrasive slurry, all without any interruptions or adjustments in the abrasive slurry supply.

What is claimed is:

1. An apparatus for machining a workpiece, including:

an assembly including a substantially rigid frame, a lapping member having a substantially flat and horizontal lapping surface, a lapping member mounting means for supporting said lapping member for horizontal movement relative to said frame, a workpiece carrier means mounted to the frame for positioning a workpiece against said lapping surface and in a selected orientation, and an abrasive supply means mounted on said frame for providing an abrasive slurry to the lapping surface at a select location with respect to said frame;

a means for moving said lapping member in a generally longitudinal first horizontal direction with respect to the frame, thereby to carry the abrasive slurry, when so provided, toward said workpiece;

a guide member, and a reciprocable support means mounted to said assembly for alternatively supporting said guide member in an operating position and in a retracted position; and an actuator means for selectively reciprocating said support means during said movement of said lapping member and thereby selectively and alternatively locating said guide member in said operating and retracted positions;

wherein said guide member, when in the operating position, is in wiping engagement with said lapping surface over a wiping area of said lapping surface spanning a transverse distance at least as great as the transverse dimension of said workpiece and located between said workpiece and said abrasive supply means, to substantially divert the abrasive slurry, when so carried by said lapping member, transversely away from said workpiece whereby the workpiece is abraded at a first rate; and wherein said guide member when retracted is spaced apart from said lapping surface to allow the lapping member to carry the abrasive slurry to the workpiece whereby the workpiece is abraded at a second rate greater than said first rate.

2. The apparatus of claim 1 wherein:

said support means is mounted to said workpiece carrier means.

3. The apparatus of claim 2 wherein:

said workpiece carrier means includes a substantially rigid elongate arm having first and second opposed arm ends, said arm mounted to said frame near said first arm end, and supporting said workpiece at said second arm end; and said support means include a yoke supporting said guide member and mounted at its opposed ends to pivot about a substantially transverse axis with respect to said second end of said arm.

4. The apparatus of claim 3 further including:

an elongate and substantially rigid bar for fixedly supporting said guide member, said bar mounted for pivoting with respect to said yoke about a longitudinal axis substantially centered on said yoke and said bar.

5. The apparatus of claim 4 wherein:

said guide member comprises an elongate, flexible wiper blade supported in a generally transverse slot running substantially the length of said bar and open along a bottom surface of said bar to permit extension of said wiper blade downwardly beyond said bottom surface.

6. The apparatus of claim 5 wherein:

said wiper blade is constructed of neoprene and is substantially rectangular, with a cross-sectional width substantially greater than its cross-sectional thickness, and wherein said blade, in the operating position, is oriented with its width dimension substantially upright.

7. The apparatus of claim 2 wherein:

said guide member comprises an elongate, elastically deformable wiper blade.

8. The apparatus of claim 7 wherein:

said wiper blade extends generally in the transverse direction, with opposed end portions of said wiper blade extending transversely beyond opposed transverse end portions of said workpiece.

9. The apparatus of claim 2 wherein:

said actuator means includes a latch arm mounted to said wordpiece carrier means for movement relative to said carrier means between a latching position wherein the latching arm retains said support means in said retracted position, and a release position wherein the latching arm allows said support means to move to said operating position responsive to gravity.

10. The apparatus of claim 9 wherein:

said latch arm is mounted pivotally with respect to said workpiece carrier means.

11. The apparatus of claim 10 further including:

a latch at the end of said latch arm nearest the support means, for capturing the support means and guiding the support means into said retracted position as the latch arm is pivoted from the release position to the latching position.

12. The apparatus of claim 11 wherein:

said actuator means includes means for pivoting said latch arm and comprising an actuator member mounted to said workpiece carrier means for longitudinal reciprocable motion therealong, an elongate linking member attached at one end thereof to the latch arm for pivoting about a generally transverse axis, an actuator bracket integral with said actuator member for slidably supporting the linking member, and first and second stop members, fixed to the linking member on opposite sides of said bracket, for limiting the longitudinal movement of said actuator member with respect to said linking member.

13. The apparatus of claim 12 further including:

a compressible spring between said bracket and the one of said first and second stop members positioned most remotely from said latch arm.

14. The apparatus of claim 13 further including:

a friction means between said workpiece carrier and said latch arm for maintaining the position of the latch arm with respect to the workpiece carrier when not translated by said linking member.

15. An apparatus for lapping a workpiece including:

an assembly including a substantially rigid frame, an annular lapping plate having a substantially flat and horizontal top lapping surface, a mounting means for supporting said lapping plate rotatably on said frame about a vertical axis, an elongate carrier arm means mounted to said frame for positioning a workpiece on the lapping surface and in a selected orientation, and an abrasive supply means mounted on said frame for providing an abrasive slurry to the lapping surface at a select location with respect to the frame;

a means for rotating said lapping plate in a first direction about said axis with respect to the frame, thereby to carry the abrasive slurry, when so provided, toward said workpiece;

a guide member and a reciprocable support means mounted to said carrier arm, for alternatively supporting the guide member in an operating position and in a retracted position; and an actuator means for selectively reciprocating said support means and thereby selectively and alternatively locating said guide member in said operating said retracted positions;

wherein said guide member, when in the operating position, is in wiping engagement with the lapping surface over a wiping area thereof, spanning a transverse distance at least as great as the transverse dimension of said workpiece and between said workpiece and said supply means, to substantially divert the abrasive slurry, when so carried by said lapping plate, transversely away from said workpiece whereby the workpiece is abraded at a first rate; and wherein said guide member when retracted is spaced apart from the lapping surface to allow the lapping plate to carry the abrasive slurry to the workpiece whereby the workpiece is abraded at a second rate greater than the first rate.

16. The apparatus of claim 15 wherein:

said workpiece is elongate and oriented with a length dimension thereof parallel to a first radius of said lapping plate along a working surface area of said lapping surface where said workpiece and lapping plate are contiguous.

17. The apparatus of claim 16 wherein:

said guide member comprises an elongate wiper blade, and said support means positions said wiper blade in proximate, spaced apart relation to the workpiece, with said wiper blade selectively inclined with respect to the workpiece to orient a length dimension of the wiper blade substantially parallel to a second radius of the lapping plate along said wiping portion.

18. The apparatus of claim 17 wherein:

said blade is rectangular, with a cross-sectional width substantially greater than its cross-sectional thickness, and wherein the support means maintains a width dimension of said blade substantially vertical.

19. The apparatus of claim 18 wherein:

said wiper blade is substantially longer than said workpiece.

20. The apparatus of claim 12 wherein:

said workpiece carrier is pivotally mounted at one end thereof with respect to said frame, and said actuator means comprises a weight selectively positionable along the length of said workpiece carrier to selectively vary the vertically downward force applied to said workpiece through said workpiece carrier.

* * * * *